US005791969A

United States Patent [19]

Lund

[11] Patent Number: 5,791,969

[45] **Date of Patent: *Aug. 11, 1998**

[54] SYSTEM AND METHOD OF AUTOMATICALLY POLISHING SEMICONDUCTOR WAFERS

[76] Inventor: Douglas E. Lund, 13304 Purple Sage, Dallas, Tex. 75240

[ * ] Notice: The portion of the term of this patent subsequent to Jul. 1, 2014, has been disclaimed.

[21] Appl. No.: 799,348

[22] Filed: Feb. 13, 1997

Related U.S. Application Data

[63] Continuation-in-part of Ser. No. 333,036, Nov. 1, 1994, Pat. No. 5,643,044.

[51] Int. Cl.[6] ..... B24B 49/12

[52] U.S. Cl. ..... 451/5; 451/6; 451/41; 451/63; 451/289; 451/307; 451/388; 451/296

[58] Field of Search ..... 451/5, 6, 41, 63, 451/285–289, 307, 296, 388, 168

[56] References Cited

U.S. PATENT DOCUMENTS

| | | | |
|---|---|---|---|
| 4,692,223 | 9/1987 | Lampert et al. | 451/6 |
| 5,433,651 | 7/1995 | Lustig et al. | 451/6 |
| 5,569,063 | 10/1996 | Morioka et al. | 451/296 |
| 5,643,044 | 7/1997 | Lund | 451/5 |
| 5,643,056 | 7/1997 | Hirose et al. | 451/41 |
| 5,645,471 | 7/1997 | Strecker | 451/59 |

FOREIGN PATENT DOCUMENTS

| | | | |
|---|---|---|---|
| 66160 | 7/1995 | Japan | 451/285 |

*Primary Examiner*—Robert A. Rose
*Assistant Examiner*—George Nguyen
*Attorney, Agent, or Firm*—Steven W. Smith

[57] ABSTRACT

A method of automatically polishing a semiconductor wafer having a substrate and a surface film. A wafer mounting device, which may include a vacuum chuck, holds the semiconductor wafer without requiring that the wafer have a central aperture. The mounting device and wafer are moved with an orbit-within-an-orbit motion while a tape transport mechanism applies an abrasive polishing tape to the surface film of the moving wafer to polish one surface of the wafer to a flatness of less than two microns. The polishing tape passes arcuately around a roller and passes between the roller and the surface film and contacts the surface film in a line running across the width of the tape. The system determines the thickness of the wafer surface film during the polishing process with a real time measurement device such as an effipsometer, or by determining a work-performed factor and calculating an estimated film thickness from the work-performed factor. Finally, the system automatically controls the polishing process to stop polishing the semiconductor wafer when the wafer surface film achieves a predefined planarization.

20 Claims, 9 Drawing Sheets

SYSTEM AND METHOD OF AUTOMATICALLY POLISHING SEMICONDUCTOR WAFERS

RELATED APPLICATIONS

This application is a Continuation-in-Part of U.S. patent application Ser. No. 08/333,036 filed Nov. 1, 1994, U.S. Pat. No. 5,643,044.

BACKGROUND OF THE INVENTION

1. Technical Field of the Invention

This invention relates to devices for manufacturing semiconductor wafers and, more particularly, to a system and method of automatically polishing the surface of semiconductor wafers.

2. Description of Related Art

Manufacturers of electronic semiconductor devices manufacture circular wafers of semiconductor material that generally have diameters ranging from four to eight inches (100–200 mm). The wafers are then cut into the sizes needed for various types of micro-processors or other semiconductor devices. The wafer substrate may be comprised of, for example, silicon, silica, simox, carbides, sapphire, or other compounds. Semiconductor device thin films may be applied to the surface of the substrate. Such thin films may be, for example, oxides, nitrides, metal oxides, polysilicon, EPI, ferroelectrics, or other metals.

The substrate/film combination must then be polished or finished to achieve a total surface flatness on the order of two microns or better. The polishing process must achieve this planar surface over the entire surface of the wafer so that semiconductor devices that are processed from any part of the wafer have the same relative flatness.

Existing systems for polishing the surface of semiconductor wafers are typified by the Model 372 Automatic Wafer Polisher from Westech Systems, Inc. The Model 372 performs the polishing process utilizing two polishing stations. A primary station performs material removal while a secondary station performs final polishing. The wafers are transported using an edge-contact shuttle, vacuum chuck, and water track.

FIG. 1 is a front side elevational view of an illustrative primary polishing station 1 according to the existing art. The primary station 1 is supplied with a polishing slurry 2 which is applied to a composite polishing pad 3 which covers the surface of a polishing pallet or table 4. The pallet 4 may have a diameter of approximately 30 inches, much larger than the semiconductor wafer. A template 5 holds the wafer 6 through a combination of side support and capillary action of water in the pores of a mounting material 7. The wafer is held in an inverted position, and is lowered from above until the wafer 6 contacts the polishing pad 3. The polishing action consists of three relative wafer motions. The template 5 holding the wafer 6 is rotated about its center, the template is oscillated across the diameter of the pallet 4, and the pallet 4 and pad 3 are rotated about the center of the pallet. This combination of motions is designed to remove material uniformly from the surface of the wafer 6. The final thickness of the wafer film is determined by estimating the amount of material removed over a given time period. More precise methods of measuring wafer thickness during the polishing process are needed.

Throughout the polishing process, critical variables include, among others, the type of polishing pad and its condition, the type of slurry, slurry PH, the condition of the slurry, the slurry flow, pad pressure, and the process temperature. Slight variations in any of these variables can, and often do, profoundly affect the outcome of the polishing process. For example, a worn or glazed polishing pad may cause major variations in the thickness of the wafer surface film. Even pads in good condition often rise up along the leading edge of the wafer as it passes over the pad. This also results in undesireable variations in wafer planarization from one area of the wafer to another. Termination of the polishing process is typically determined by polishing for a pre-determined time period. However, this method results in inconsistencies in final film thickness from one wafer to the next due to changes in the variables outlined above. Better methods of controlling the removal of film material to achieve uniform wafer flatness, across the entire surface of a wafer and from one wafer to the next, are needed.

Although there are no known prior art teachings of a solution to the aforementioned deficiencies for polishing the surface of semiconductor wafers, there are a number of existing devices that are utilized in the computer hardware industry to abraid, burnish, and/or polish the surfaces of disks utilized in hard disk drives. Such devices are disclosed in U.S. Pat. Nos. 5,099,615 to Ruble et al., 5,065,547 to Shimizu et al., 4,736,475 to Ekhoff, and 4,347,689 to Hammond. Each of these references is discussed briefly below.

U.S. Pat. No. 5,099,615 to Ruble et al. discloses an automated rigid-disk finishing system for computer hard disks. The system includes an abrasive tape, a means for forcibly pressing the tape against the disk substrate, and a means for controlling the process to control the speed and tension of the tape. The disk has a hole in the center and is mounted on a spindle for rotation. As the disk is rotated, the abrasive tape is moved through the area of the tape/substrate interface thereby cutting concentric microscopic grooves into the substrate's surface. Both sides of the disk are simultaneous finished in this manner.

The Ruble device cannot, however, be utilized to polish the surface of semiconductor wafers for several reasons. First, only one side of semiconductor wafers is polished, and Ruble does not allow the mounting of a wafer for one-sided polishing. Second, semiconductor wafers do not have a hole in the center; therefore, the spindle mount utilized in Ruble will not function with semiconductor wafers. Finally, Ruble finishes the surface of the substrate with grooves cut in concentric circles. Semiconductor wafers, conversely, require an orbital polishing to polish the entire surface, including the area in the center of the wafer, to a uniform flatness and smoothness rather than finishing the surface with concentric grooves.

U.S. Pat. No. 5,065,547 to Shimizu et al. discloses a surface processing machine utilizing a tape cartridge to polish or grind the surface of a computer hard disk. Shizu, unlike Ruble, polishes only one side of a disk at a time. However, like Ruble, Shimizu utilizes a spindle mount for the hard disk and is therefore only suitable for disks which have a hole in the center. Therefore, Shimizu will not function with semiconductor wafers which do not have a central hole. Additionally, Shimizu polishes only in a concentric circular pattern, and is therefore, unsuitable for orbitally polishing semiconductor wafers.

U.S. Pat. No. 4,736,475 to Ekhoff discloses a surface finishing apparatus for disks which can hold more that one disk at a time, but otherwise has the same disadvantages and drawbacks as Ruble and Shimizu where semiconductor wafers are concerned.

U.S. Pat. No. 4,347,689 to Hammond discloses an apparatus for burnishing the coated recording surface of magnetic disks. Hammond polishes only one side of a disk at a time, utilizes a spindle through a central hole in the disk to hold the disk in place, and polishes in concentric circles. Therefore, for the reasons noted above, Hammond is also unsuitable for use with semiconductor wafers.

Review of each of the foregoing references reveals no disclosure or suggestion of a system or method such as that described and claimed herein.

It would be a distinct advantage to have a system and method of automatically polishing semiconductor wafers which polishes one side of a wafer, holds the wafer in place without requiring a central aperture, polishes the surface of the wafer to a microscopically smooth surface, provides an accurate measurement of wafer thickness in real time during the polishing process, and achieves a more accurate uniform thickness than existing wafer polishing machines, regardless of the surface film's hardness, density, and index of refraction. The present invention provides such a system and method.

SUMMARY OF THE INVENTION

In one aspect, the present invention is an automated system for polishing a semiconductor wafer having a substrate and a surface film. The system comprises means for holding the semiconductor wafer without requiring that the wafer have a central aperture, and means for polishing one surface of the wafer to a microscopically smooth surface. Additionally, the system includes means for determining the thickness of the surface film in real time while polishing the wafer. The means for determining the thickness of the surface film determines thicknesses of less than 100 angstroms regardless of the surface film's index of refraction. The measurement device is preferrably an ellipsometer, or may be a means for determining a work-performed factor and calculating an estimated film thickness from the work-performed factor. Finally, the system includes means for automatically controlling the polishing process which includes: a control computer; an interface between the control computer, the polishing means, and the thickness determining means for adapting the system to surface films of various hardnesses, densities, and refractive indices; and means for stopping the polishing means when the thickness of the surface film, averaged over the entire surface of the wafer, achieves a predefined value, regardless of the surface film's hardness, density, or index of refraction.

In another aspect, the present invention is a method of automatically polishing a semiconductor wafer having a substrate and a surface film. The method includes the steps of holding the semiconductor wafer without requiring that the wafer have a central aperture, polishing one surface of the wafer to a microscopically smooth surface by applying a polishing tape to the surface film of the wafer with a tape transport mechanism, the tape contacting the surface film in a line, determining the thickness of the surface film in real time while polishing the wafer, and automatically controlling the polishing step with a control computer. The step of automatic controlling the polishing step includes the steps of providing measurements of the surface film thickness to the control computer in real time, and stopping the polishing step when the thickness of the surface film, averaged over the entire surface of the wafer, achieves a predefined value.

BRIEF DESCRIPTION OF THE DRAWINGS

The invention will be better understood and its numerous objects and advantages will become more apparent to those skilled in the art by reference to the following drawing, in conjunction with the accompanying specification, in which.

DETAILED DESCRIPTION OF EMBODIMENTS

Figure 1:
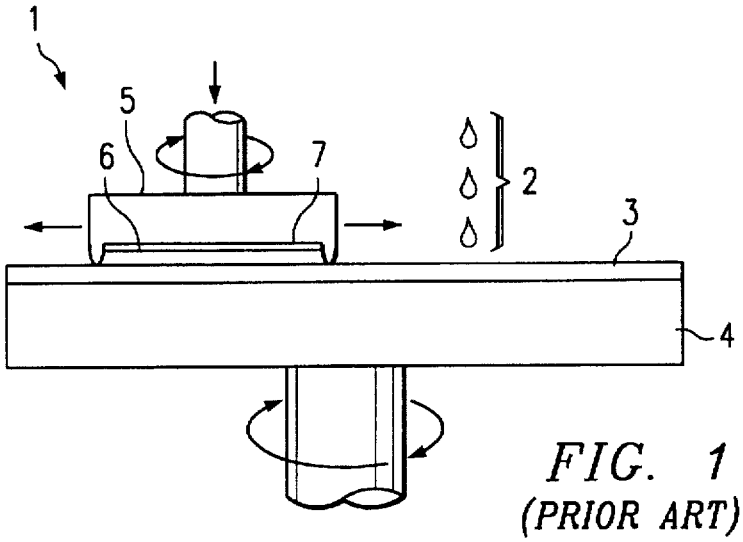
FIG. 1 (PRIOR ART)
FIG. 1 (Prior Art) is a front side elevational view of an illustrative primary polishing station according to the existing art.
Figure 2:
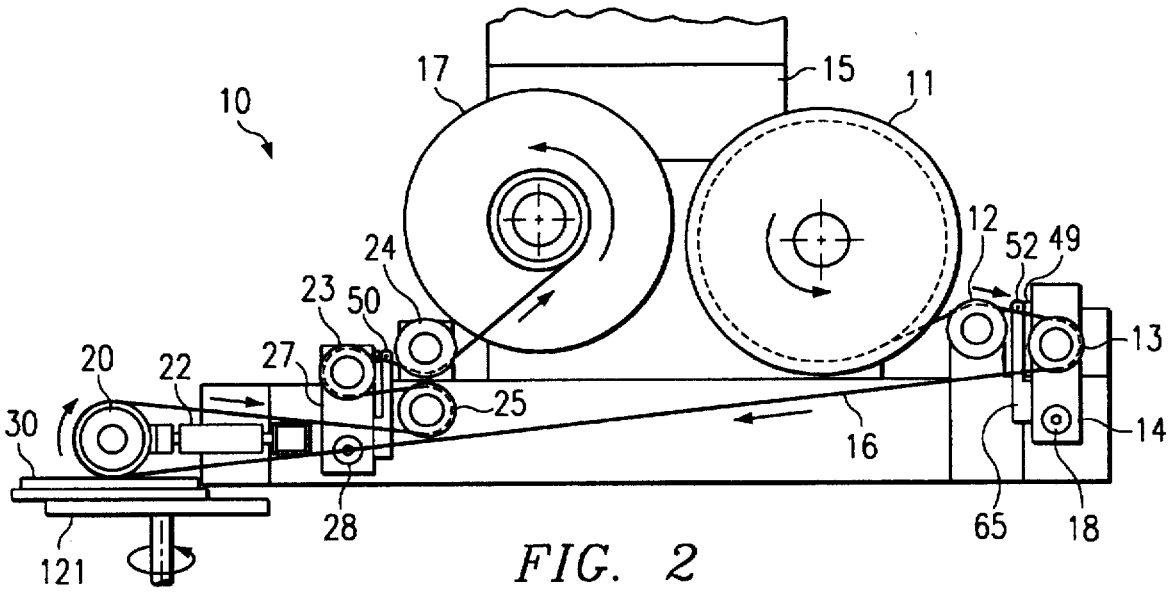
FIG. 2 is a front view of the tape transport mechanism of the chemical mechanical polishing system of the present invention.

FIG. 2 is a front view of the tape transport mechanism of the polishing system 10 of the present invention. The system 10 includes an assembly for polishing or finishing one surface of an orbitally rotating semiconductor wafer 30. The wafer may be attached to a mounting mechanism 100 in a number of alternative ways, and rotated in an orbit-within-an-orbit manner at a relatively high velocity. An abrasive tape 16 is then forcibly pressed onto the front surface of the wafer 30 by a load roller assembly 20, thereby smoothly polishing the wafer's surface. The system 10 is illustrated in FIG. 1 in position to polish a horizontally mounted wafer 30. However, the system 10 may also be rotated 90 degrees to polish a vertically mounted wafer, thereby reducing the footprint of the system.

Figure 3:
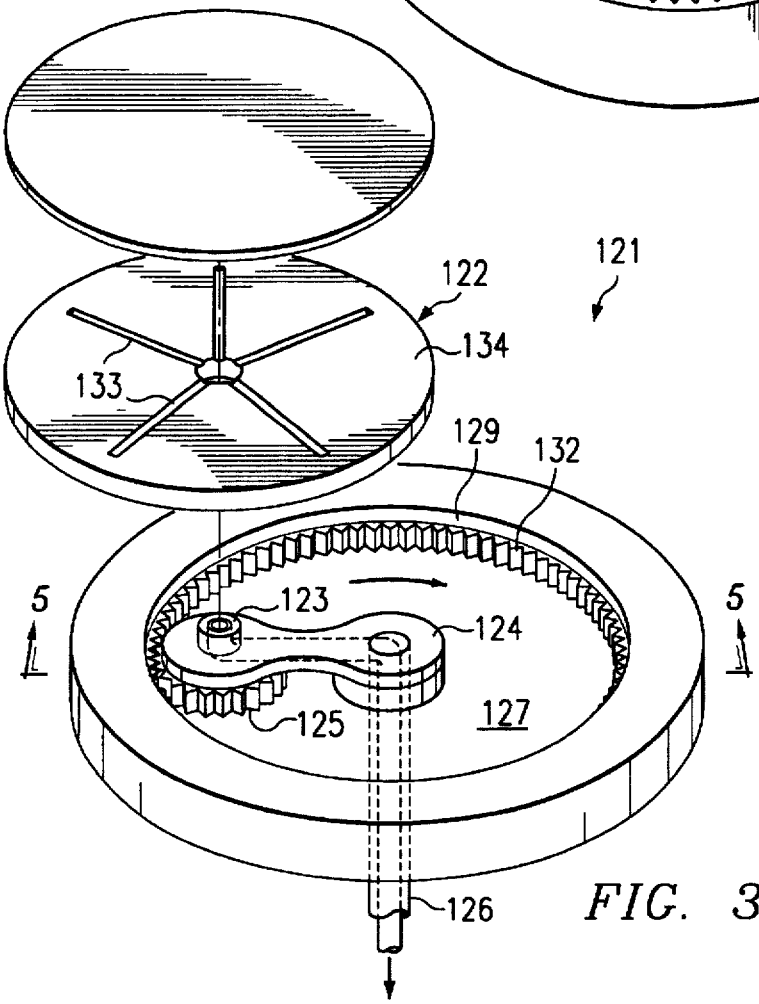
FIG. 3 is an exploded perspective view of a preferred wafer mounting mechanism of FIG. 2.

FIG. 3 is an exploded perspective view of a preferred wafer mounting mechanism 121 of FIG. 2. The mounting mechanism 121 includes a vacuum chuck 122 which is securely mounted to a rotating shaft 123. The shaft 123 extends through an aperture in one end of a dog bone connector 124 where it is securely mounted to a gear 125. The other end of the dog bone connector 124 is securely mounted to a rotating central shaft 126 which extends through an aperture in the floor 127 of the mounting mechanism 121. An annular chamber is formed by the circular side 129 of the mounting mechanism 121. The interior wall of the mounting mechanism side 129 is equipped with gear teeth 132 sized to mesh with gear 125.

Figure 4:
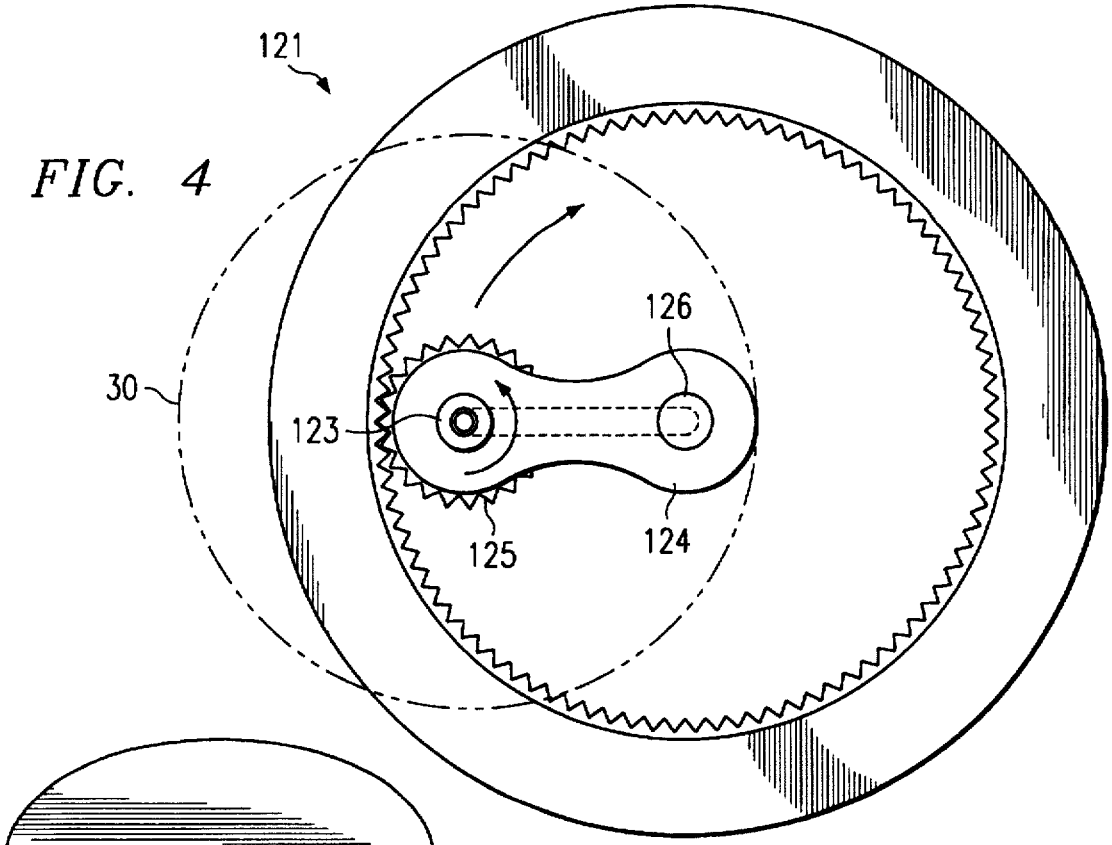
FIG. 4 is a top side view of the wafer mounting mechanism of FIG. 3.

FIG. 4 is a top side view of the wafer mounting mechanism 121 of FIG. 3. By rotating the central shaft 126, the dog bone connector 124 is rotated, thereby rotating the gear 125 in a circular motion around the inside of the mounting mechanism 121. Gear teeth 132 cause the gear 125 to rotate in the opposite direction of the gear's movement. Thus, as shown in FIG. 4, as the gear 125 rotates clockwise around the rotating central shaft 126, the gear rotates counter-clockwise around shaft 123. The rotation of the gear 125 causes the shaft 123 and vacuum chuck 122 (FIG. 3) to rotate in the same direction. Thus, an orbit-within-an-orbit motion is imparted to the vacuum chuck 122 and the wafer 30 mounted thereupon.

The wafer 30 may be held by the mounting mechanism 121 in several alternative ways, for example, by vacuum pressure or by side-edge pressure. In the preferred embodiment, as illustrated in FIG. 3, the wafer 30 is held by vacuum pressure. The vacuum chuck 122 is formed with vacuum grooves 133 in its upper (outward) surface 134. A rotary vacuum mechanism 135 (see FIG. 5) is utilized to deliver a partial vacuum through shaft 123 to the space formed between the vacuum grooves 133 and the lower (inward) surface of the wafer 30 when the wafer is placed in contact with the upper surface 134 of the vacuum chuck 122. The required vacuum need not exceed 750 Torr gauge, i.e., a negative pressure of 10 Torr.

Figure 5:
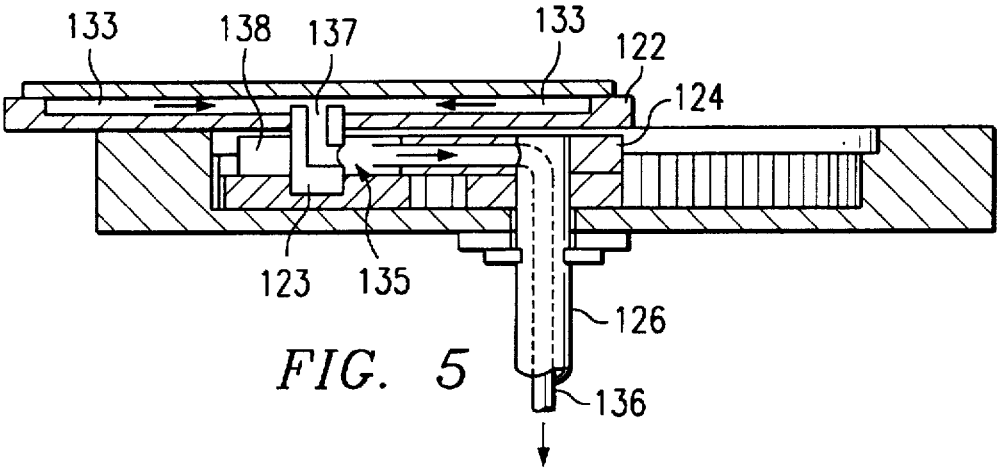
FIG. 5 is a cross-sectional view of the wafer mounting mechanism of FIG. 3 taken along line 5—5.

FIG. 5 is a cross-sectional view of the wafer mounting mechanism 121 of FIG. 3 taken along line 5—5. Vacuum line 136 is shown extending through the center of the rotating central shaft 126, through the dog bone connector 124, to the shaft 123 where it connects to the rotary vacuum mechanism 135. The rotary vacuum mechanism 135 may comprise an annular vacuum chamber 138 surrounding the shaft 123. Within the shaft 123 is a second vacuum line 137 which is open at one end to the annular vacuum chamber 138. The other end of the second vacuum line 137 is open to the vacuum grooves 133 in the upper surface 134 of the vacuum chuck 122.

Figure 6:
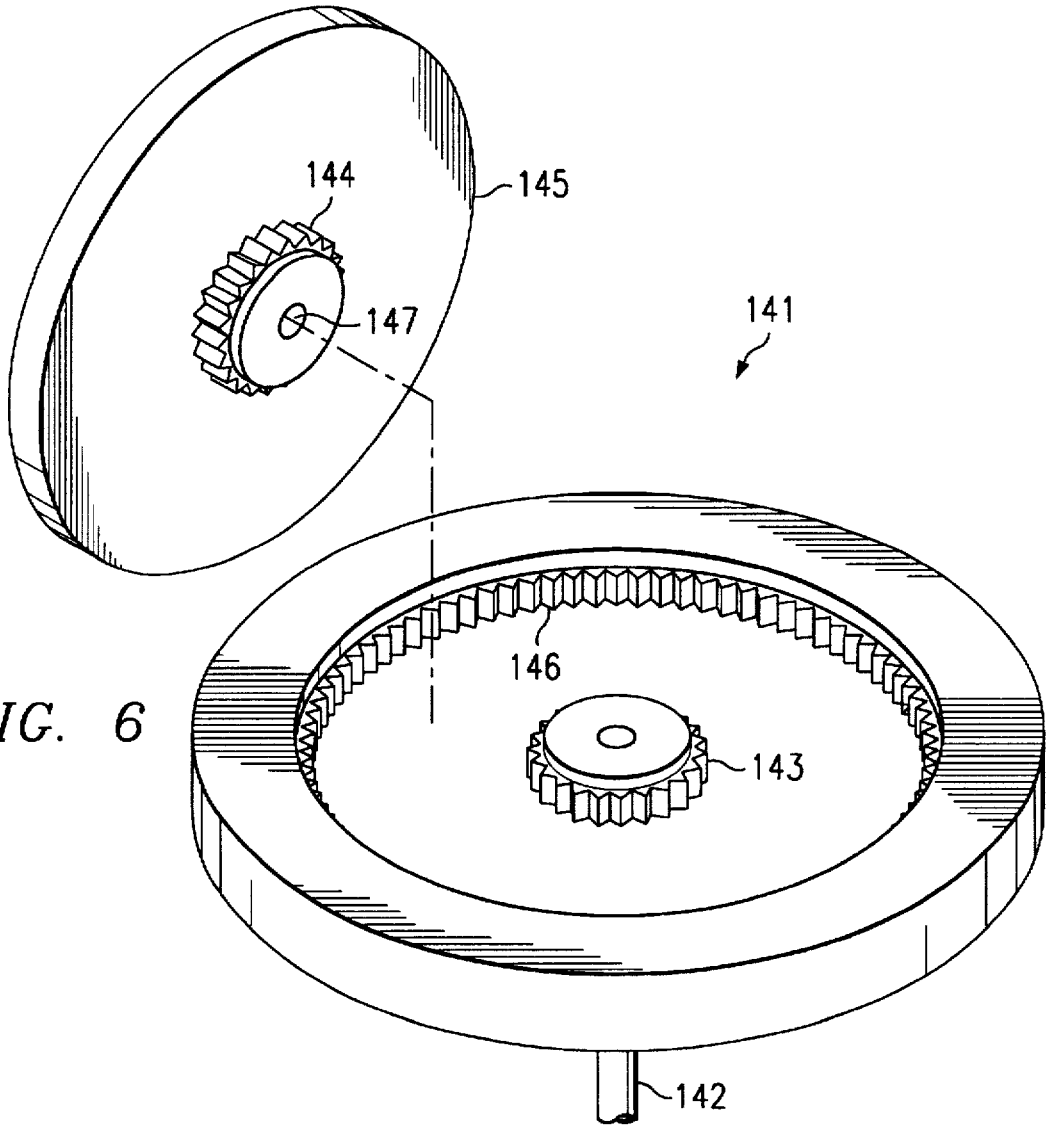
FIG. 6 is an exploded perspective view of an alternative embodiment of the wafer mounting mechanism of FIG. 2.

FIG. 6 is an exploded perspective view of an alternative embodiment of a wafer mounting mechanism 141. A rotating central shaft 142 turns a central gear 143. The central gear 143 turns a second gear 144 which is mounted to the bottom of a mechanical chuck 145. The interior wall of the side of the mounting mechanism is equipped with gear teeth 146 sized to mesh with the second gear 144. Thus, as the rotating central shaft rotates clockwise, the second gear 144 is moved in a clockwise direction around the central shaft 142 while it is rotated counter-clockwise around its own axis 147. Thus, an orbit-within-an-orbit motion is imparted to the mechanical chuck 145 and the wafer 30 mounted thereupon.

Referring again to FIG. 2, the abrasive tape 16 may be, but is not limited to (1) dry impregnated abrasive tape, (2) wet impregnated abrasive tape, (3) dry impregnated/coated abrasive/chemical tape, (4) wet impregnated/coated abrasive/chemical tape including various wetting agents, (5) dry fabric web tape, and (6) wet fabric web tape utilizing liquid slurry, liquid chemicals, or other wetting agents. Tapes may be constructed with any suitable flexible backing, including paper, cloth, mylar, or special polyester wet/dry paper. A dry impregnated tape may comprise, for example, aluminum oxide or some other similar abrasive embedded in a binder system which is then coated onto a flexible mylar backing.

Tape 16, which may be approximately two thousandths of an inch in thickness, is originally wound around supply reel 11. From there it is threaded around upper tape guides 12 and 13, around load roller 20, lower tape guides 25, 23 and 24; eventually to be collected by take-up reel 17. Take-up reel 17 is mounted to an ordinary DC gear motor 37 (see FIG. 7) which winds up tape 16 at a constant speed. The shaft of motor 37 is coupled to a transducer 38 which measures the shaft speed of motor 37. This aspect of the invention will be discussed in more detail later.

In a typical process, motor 37 turns at a rate such that approximately seven inches of tape are passed over load roller 20 per minute. A typical processing cycle for a single wafer may last approximately 20–120 seconds, utilizing about 3–14 inches of tape for each wafer. This may result in less than one revolution of reel 17, and the radius of the tape wound around reels 11 and 17 may remain virtually constant during a given process cycle.

During polishing of the wafer, a portion of the tape—which may be hundreds of feet in length—is transferred from supply reel 11 to take-up reel 17. Tape guides 12, 13 and 23–25, along with an electrically-controlled brake 36 (again, see FIG. 7) attached to supply reel 11, provide proper tensioning of tape 16 during the polishing process. As motor 37 winds tape 16 at a constant velocity, brake 36 simultaneously establishes supply side tension in tape 16. Both motor 37 and brake 36 are controlled by servo mechanisms so that each may be programmed to a user-defined setting. Note that the arrows in FIG. 2 denote the direction that the tape travels during processing, while the arrows in FIG. 8 denote the direction of the various tape tension forces.

Figure 8:
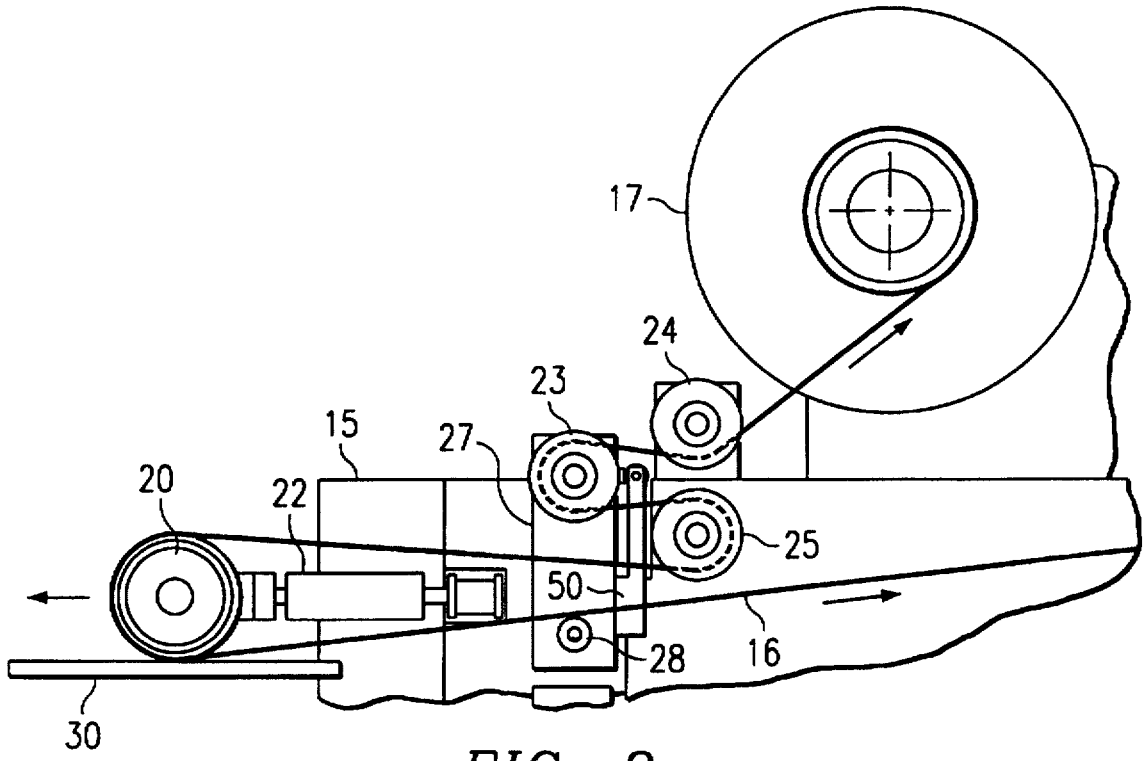
FIG. 8 is an expanded view of a portion of the tape transport mechanism which is closest to the load roller, and includes arrows indicating the various components of force which are applied to the tape during the polishing process.

The load roller 20 of FIG. 2 is mounted to a block assembly 22 which provides a means for positioning roller 20 in close proximity to the substrate surface. Block 22 is mounted onto chassis 15 and is coupled to a force applications means—either an electro-mechanical, pneumatic or hydraulic system may be used—to forcefully press the load roller against the side of the wafer so that tape 16 may abrasively remove material from the orbitally rotating wafer. FIG. 8 shows the orientation of the wafer 30 in relation to load roller 20. In the preferred embodiment, an electromechanical assembly is utilized for applying force to the roller. Because the force application means associated with block 22 and load roller 20 is relatively non-essential to the understanding of the present invention, it will not be described in further detail.

The load roller 20 comprises a cylindrically-shaped metal drum having rubber, or other similar material, covering its outer surface. In the preferred embodiment, rubber is used to a thickness of approximately three-eighths of an inch. The length of the roller is usually chosen to be slightly longer than the radius of wafer 30.

When the load roller is forced against the substrate surface, the rubber compresses to form a flat contact region called the nip. The nip is the area where the actual work (i.e., abrasive cutting) is performed on the wafer. The extent to which the load roller is compressed against the wafer (i.e., the length of the nip) is generally less than one tenth of an inch in length. The nip extends in a line across the width of the tape 16.

The load roller 20 is mounted to block assembly 22 along an axis which extends through the center of the roller. A bearing system within load roller 20 permits free rotational movement of the load roller around its axis. This allows the load roller to rotate with the speed of tape 16 during polishing.

With continuing reference to FIG. 2, tape guide 13 is shown rotatably mounted onto bracket member 14. Bracket member 14, in turn, is pivotally mounted to chassis 15 along axis 18. The extended portion of bracket member 14 is suspended by the outer end of upper tension beam 65. The other end of beam 65 is rigidly mounted to chassis 15. Preferably, the outer end of beam 65 supports bracket member 14 in space at a point directly under tape guide 13. This insures that the tension developed about guide 13 is not attenuated as it is transferred to beam 65. Note that as tape 16 passes over guide 13 during processing, guide 13 also rotates at an angular velocity which is directly or linearly proportional to the velocity of the tape.

The operation of motor 37 and brake 36 produce a tension in tape 16 which causes bracket member 14 to forcefully press against upper tension beam 65. This generates a strain or deflection in beam 65 which is then measured electronically. The magnitude of the deflection, of course, depends on the applied tension and the material composition of each of the involved elements, particularly beam 65. In the preferred embodiment, beam 65 comprises ordinary aluminum; however, it is appreciated that a variety of other materials may be substituted and still achieve accurate results. Thus, by transferring the tension developed around tape guide 13 to beam 65, a quantitative measurement of the tape tension on the upper end of the assembly is made.

Exactly the same kind of tension sensing means is provided on the lower portion of system 10 to measure tape tension at a point on tape 16 between load roller 20 and take-up reel 17. Tape guide 23 is illustrated in FIG. 2 as being rotatably mounted onto bracket member 27. Bracket member 27 is pivotally attached to chassis 15 at axis 28. Ordinarily, guide 23 and bracket 27 are held in a horizontal position by the tension in tape 16. Bracket 27 is attached to chassis 15 such that if guide 23 did not have tape 16 threaded around its outer surface, it would simply drop downward about axis 28 from the force of gravity.

Once tension is established in tape 16, lower tension beam 50 experiences strain in the same manner as described above in conjunction with beam 65. That is, the pressure exerted against beam 50 by bracket member 27 generates a strain or deflection which is then detected by electronic instrumentation. Hence, tape tension is measured on both sides of load roller 20—the side of tape 16 feeding into roller 20 from supply reel 11, and also on the side leading away from roller 20 into take-up reel 17.

The function of tape guides 12, 24 and 25 may now be described in more detail. Tape guide 12 is located between guide 13 and supply reel 11 so as to be able to slightly deflect the path of tape 16 as it unwinds. Recognize that the radius of the wound tape on reel 11 can vary considerably throughout a processing session (i.e., spanning many wafers) depending on how much tape has been used during previous processing cycles.

This means that the angle at which tape 16 unwinds from reel 11 varies with the radius. If tape 16 were passed directly from reel 11 around tape guide 13 without first passing over guide 12, the moment force applied to tape guide 13 would deviate with the radius of the remaining tape on reel 11. In other words, the same tape tension on tape 16 being supplied from reel 11 at different angles would lead to uncertain strain measurements. Therefore, the purpose of guide 12 is to assure that the angle formed by tape 16 as it enters and exits guide 13 remains constant. This guarantees that the force measured by upper tension beam 65 will directly correspond to the actual tension being generated in tape 16 by motor 37 and brake 36.

Tape guides 24 and 25 function in an identical manner with respect to guide 23. Tape guide 24 assures that changes in radius about reel 17 have no influence on the force being applied to guide 23, and therefore to beam 50. Tape guide 25 directs the path of tape 16 around guide 23 such that the entire tension force is applied to beam 50 in an upward direction. Recognize that the placement of reels 11 and 17, along with tape guides 12, 13, 23, 24 and 25 allow tape 16 to be delivered to the wafer surface in such a manner that the abrasively-coated side of the tape does not contact anything from the time it leaves reel 11 to the time it reaches the wafer. This eliminates the possibility of wear or contamination of the abrasive surface of tape 16 prior to the point at which it contacts the wafer.

An important feature of the present invention is its ability to accurately determine the remaining thickness of the semiconductor wafer and film during the process of material removal. This real time process monitoring capability provides for accurate termination of the process and consistent film thicknesses from wafer to wafer. In the preferred embodiment, an ellipsometer is utilized to measure film thickness. Other embodiments may use an inter-ferometer, a reflectometer, or a laser based optiprobe for metal films. A suitable reflectometer is commercially available from Nanometrics, Inc., and a suitable laser based optiprobe is available from Therma-Wave, Inc.

Figure 10:
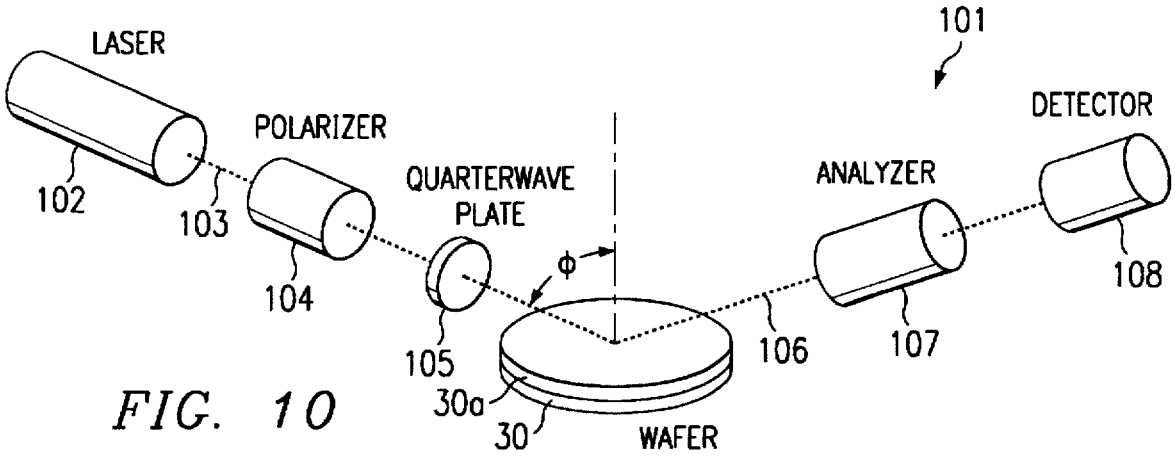
FIG. 10 is an illustrative drawing of an ellipsometer suitable for use in the preferred embodiment of the present invention.

FIG. 10 is an illustrative drawing of an ellipsometer 101 suitable for use in the preferred embodiment of the present invention. Ellipsometers are commercially available from instrument manufacturers such as Geartner Scientific and Rudolph Instruments in the United States and Plasmos in Germany. An ellipsometer is utilized in the preferred embodiment because it can measure the thickness of the semiconductor wafer film with accuracies in the range of angstroms, and total surface film thicknesses of 100 angstroms or less. An interferometer, on the other hand, is less accurate and may measure the film thickness with an accuracy of approximately one percent of the thickness of the film.

The measurement principles of ellipsometry are based upon the reflection of polarized light as described in the Fresnel equations. The ellipsometer may comprise a laser emitter 102 which emits a collimated monochrome beam of light 103. The laser beam 103 passes through a polarizer 104 and a quarterwave ($\lambda/4$) plate 105 before striking the surface of the semiconductor wafer 30 at an angle of incidence $\phi$. The reflected polarized light beam 106 then passes through an analyzer 107 into a detector 108. In one embodiment of an ellipsometer, known as a rotating analyzer ellipsometer, the analyzer 107 is rotated in front of the detector 108. The output of the detector 108 is analyzed using a Fourier transformation to determine Psi and Delta angles for various refractive indices of the wafer film. These angles are then analyzed using well known Fresnel equations to determine the thickness of the film. Rotating analyzer ellipsometers are capable of making thickness measurements in less than one second.

In another embodiment of an ellipsometer, known as a nulling ellipsometer, both the polarizer 104 and the analyzer 107 are rotated to minimize the readout at the detector 108. Nulling ellipsometers utilize simpler software, electronics, and optics than the rotating analyzer arrangement, but are slower in measurement time.

Figure 11:
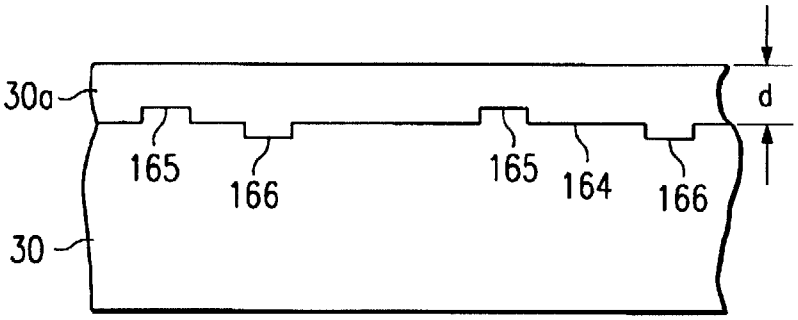
FIG. 11 is an expanded side view of the semiconductor wafer and surface film of FIG. 10.

FIG. 11 is an expanded view of the semiconductor wafer 30 and surface film 30a. The top surface of the wafer substrate 30 includes structural elements of a circuit layout. The structure includes ridges 165 that rise above the average level of the surface 164 as well as shallow isolation trenches 166 that decend below the average surface level. The above real-time measurement devices report film thickness at a large number of locations across the surface of the wafer. The present invention computes an average thickness value and terminates processing when the average film thickness d reaches a predetermined value.

Figure 12:
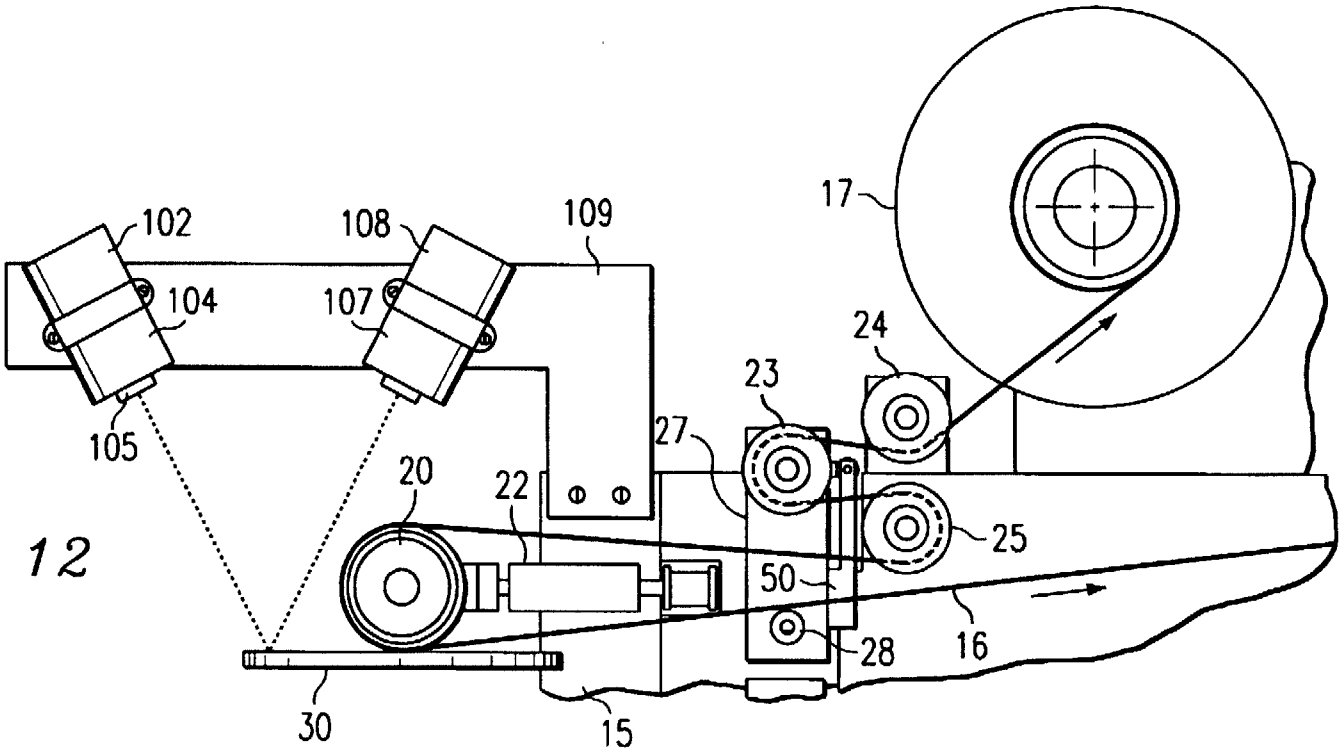
FIG. 12 is an expanded view of a portion of the tape transport mechanism with the ellipsometer of FIG. 10 mounted in an exemplary manner thereon.
Figure 13:
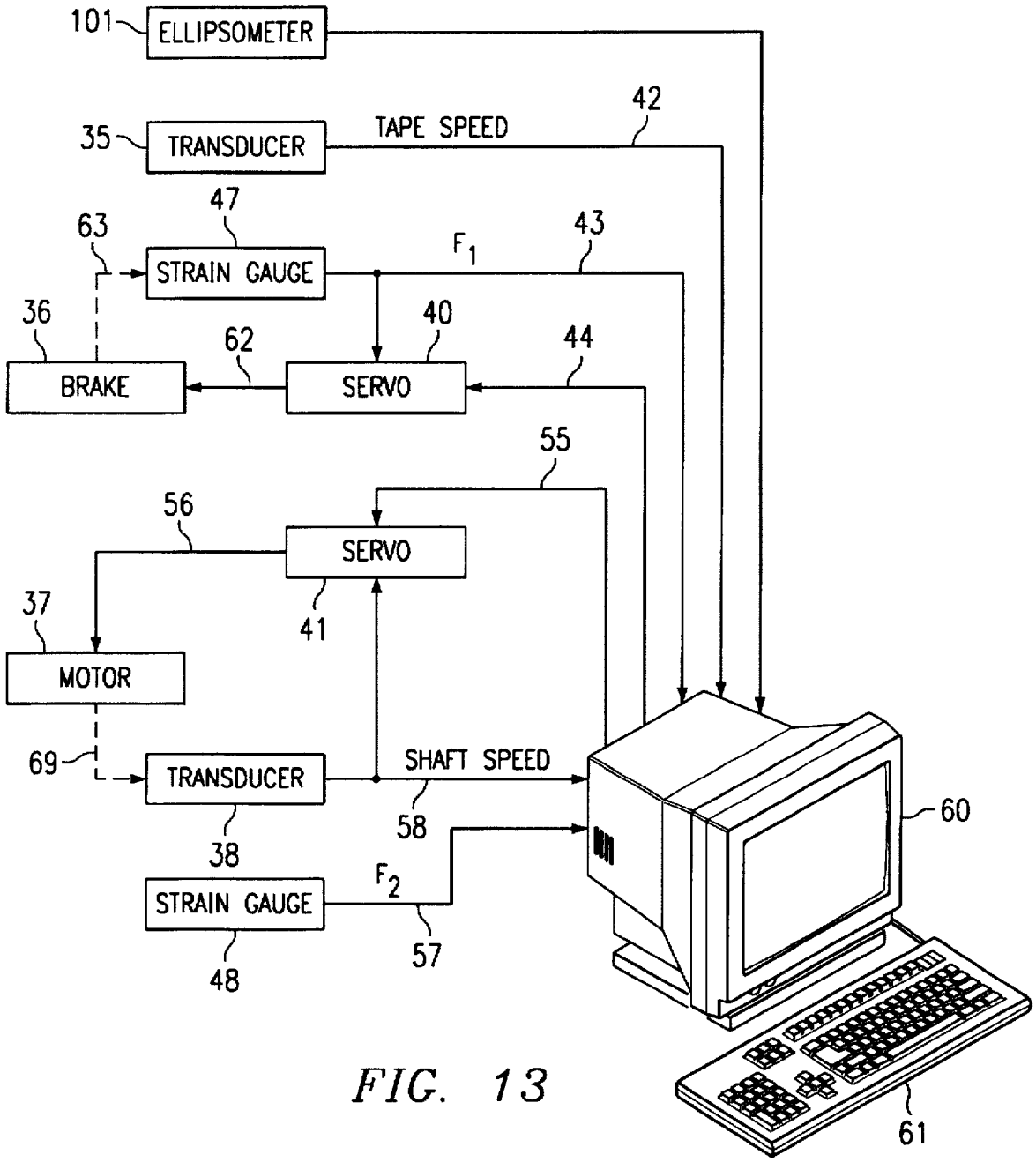
FIG. 13 is a high level block diagram illustrating the instrumentation and control elements of the present invention.

FIG. 12 is an expanded view of a portion of the tape transport mechanism with the ellipsometer of FIG. 10 mounted in an exemplary manner thereon. A bracket 109 attached to the chassis 15 may be utilized to mount the ellipsometer in a position having an unobstructed view of the surface of the wafer. The ellipsometer is connected by electrical wiring to a power source (not shown) and to the control computer 60 (FIG. 13).

In an alternative embodiment, the system of the present invention determines when to terminate the polishing process by calculating a work-performed factor, and estimating the average thickness of the wafer surface film over the entire surface of the wafer by applying the work-performed factor to the period of time that the wafer has been polished. The system controls tape speed and tape tension simultaneously, to derive the work-performed factor at the tape/substrate interface. The following example illustrates the calculation of the work-performed factor.

Assume that the user has programmed a certain tape speed and tape tension into the system's computer controller. Further assume that the system is operating in an unloaded condition; that is, load roller 20 is not in contact with wafer 30. Referring again to FIG. 8, two components of force, (representing the tape tension) are produced along tape 16 as a result. Force $F_1$ represents the drag force being applied to the portion of tape 16 between supply reel 11 and load roller 20. Force $F_2$ represents the pull force applied to tape 16 on the portion of the tape between take-up reel 17 and load roller 20. In the absence of external forces, such as is the case in the unloaded condition, $F_1$ must be equal to $F_2$, or, mathematically, $$F_1-F_2=0$$

The tension sensing means comprising upper and lower tension beams 65 and 50, respectively, are preferably calibrated at this point in the processing cycle. Any difference between the tape tension measurements of beams 65 and 50 in the unloaded position must be due to instrumentation error and the relatively small bearing drag associated with the roller—assuming, of course, that tape 16 is not accelerating during the calibration sequence. This difference in tension measured across the two portions of tape 16 in the unloaded condition is denoted $\Delta_1$, and is stored in a register as a correction factor for later measurements.

When the load roller 20 is loaded onto the surface of the wafer substrate 30, a third component of force, $F_3$, is developed on tape 16. The force $F_3$ results from the friction between tape 16 and substrate 30, and is often relatively high due to the abrasive nature of the tape. Since tape 16 advances in the same direction as the direction of rotation of substrate 30, the Force $F_3$ acts to reduce the tension on the portion of tape 16 between load roller 20 and take-up reel 17. This means that the magnitude of tension force $F_2$ drops whenever roller 20 is loaded onto the substrate. Mathematically, the relationship between the various forces after the roller has been loaded onto the substrate is given by the equation $$F_1-(F_2+F_3)=0$$

When the wafer is loaded, the system is still braking reel 11 to maintain its programmed value of tension. At the same time, motor 37 is maintaining its programmed value of tape speed. Both motor 37 and brake 36 are controlled using an ordinary servo mechanism. This aspect of the present invention will be described in more detail below.

The force $F_3$ is the work-performed factor. It represents an inferred value of the actual work being performed by the tape in the region of the nip and is a collective function of each of the various processing parameters: load roller force, wafer RPM, the density of the abrasive mineral embedded in tape 16, the value, nature and viscosity of the liquid lubricant being applied, etc. In other words, it is a function of virtually everything that goes on in the polishing process. If the applied load roller force were to be increased, for example, the increase would appear quantitatively in the calculation of $F_3$. Tension forces $F_1$ and $F_2$ are measured on opposite sides of the nip. The tape tension force $F_1$ is measured using upper tension beam 65, while tension force $F_2$ is measured directly using lower tension beam 50.

Calculating $F_3$ directly from tape tension measurements also provides the user with a process control tool. For example, a user may program a set of process parameters—such as tape tension, tape speed, load roller force, etc.—and obtain a quantitative measure of the actual work being done for that set of parameters. This information is then stored in a database to be used for further experimentation or to create a process history over time. In an in-line system, the information about the work-performed factor may also be utilized as a quality control criterion.

Consider a hypothetical situation in which a portion of tape 16 contains a non-uniform distribution of mineral, or that the particle size varies drastically from one section of the tape to another. Such asperities are not uncommon in abrasive tapes used in modern finishing systems. When the defective portion of the tape appears at the nip, the work-performed factor will be observed to change—perhaps drastically. If the work-performed factor changes beyond established control limits, the user is alerted to this condition. Information regarding the work-performed factor may be recorded into a computer database for future reference. Thus, by simultaneously establishing a constant tape speed and tape tension, the work-performed factor may be continuously monitored by calculating the difference between the tape tension on either side of load roller 20. This allows in-line, real-time quality control in a finishing system.

Tape speed is measured in two locations in the system. Referring again to FIG. 7, a transducer 35 is attached to the axis of the rotating drum of tape guide 13. As previously mentioned, tape guide 13 comprises a cylindrical drum which is rotatably mounted to bracket member 14. The axis of guide 13 extends to the back side of bracket 14 and into transducer 35. Transducer 35 acts as a tachometer—converting the rotational motion of tape guide 13 into an electrical signal corresponding to actual tape speed. Since the cylindrical drum of tape guide 13 rotates at exactly the same velocity as does tape 16, transducer 35 measures the true speed of tape 16.

Figure 7:
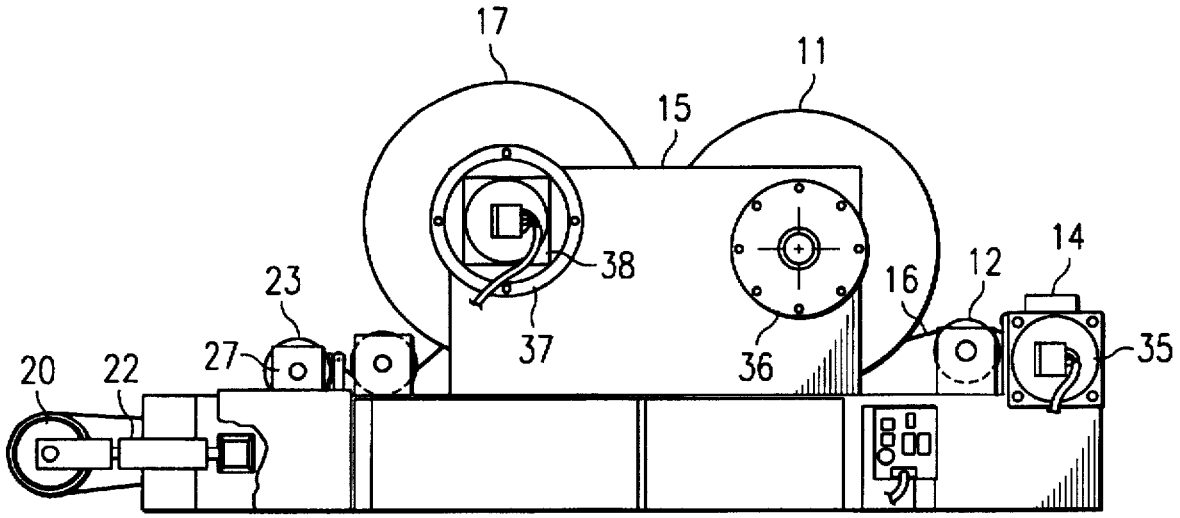
FIG. 7 is a rear view of the chemical mechanical polishing system of FIG. 2.

Transducer 38 is shown in FIG. 7 attached to the rear of motor 37. The purpose of transducer 38 is to measure the shaft speed of motors 37 as it turns the hub of reel 17. It does not directly measure the actual speed of tape 16. Because the radius of the tape wound around take-up reel 17 varies, the ratio remains virtually constant. Therefore, prior to the beginning of a processing cycle, true tape speed is measured using transducer 35. The shaft speed of motor 37 is then measured using transducer 38. The difference between the two, which is denoted $\Delta_2$, is used to calibrate the shaft speed of motor 37 to the actual speed of tape 16. In other words, the calibration process allows the system to determine what shaft speed it needs to drive motor 37 at in order to sustain the programmed tape speed for a given cycle.

For example, when the radius of the tape wound around reel 17 is very small, i.e., near the hub, motor shaft speed more nearly approximates the true tape speed as measured by transducer 35. The difference $\Delta_2$ in this case is relatively small. On the other hand, when the radius of the wound tape around reel 17 is very large, the shaft speed of motor 37 must be considerably slower to achieve the same tape speed. Thus, the difference $\Delta_2$ is used in the calibration scheme to sustain a programmed tape velocity by setting the appropriate shaft speed throughout the processing cycle. Once shaft speed has been calibrated to actual tape speed for a given process cycle, it remains at that speed throughout the cycle. Of course, this tape speed calibration process depends upon the assumption that the radius of the tape wound around reel 17 does not change during the processing cycle. Since only several inches of tape 16 are collected around reel 17 during a single processing cycle of a wafer, tape radius is virtually constant.

It is appreciated that immediately upon the loading of roller 20 against the surface of substrate 30, tape 16 stretches. Until several moments later when the system settles, both the tape speed and the tape tension are in flux. By calibrating the shaft speed of motor 37 in the unloaded condition and then maintaining that speed throughout the processing cycle, the bandwidth of the tape motion control system is effectively reduced to zero during the transient response period when the roller is loaded. The same is true with respect to brake 36 which is also calibrated prior to loading in order to establish proper tape tension, as will be described in more detail later.

Figure 9:
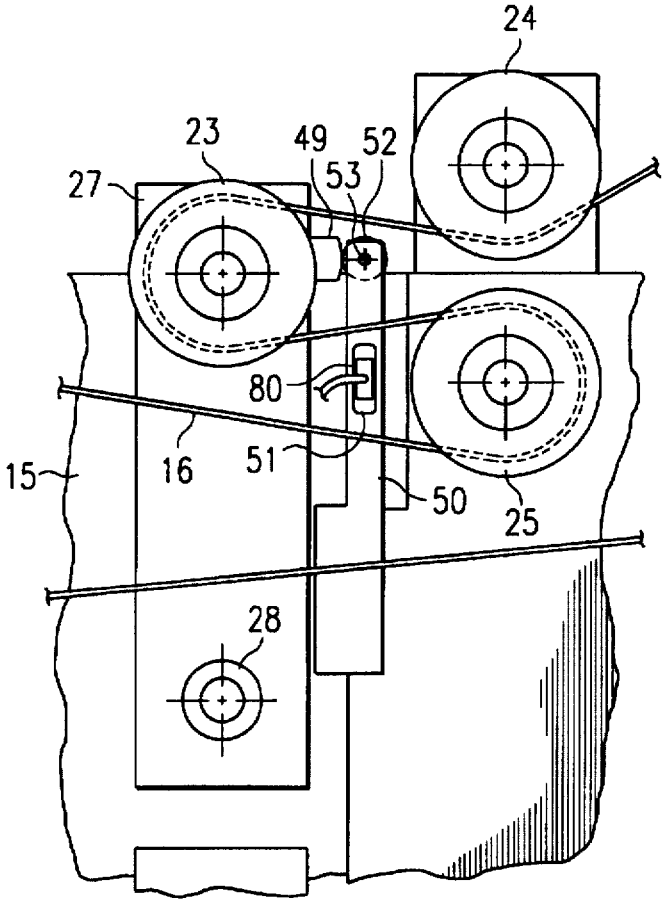
FIG. 9 is a detailed view of the lower tension beam of the chemical mechanical polishing system of FIG. 2.

With reference to FIG. 9, a detailed view of lower tension beam 50 is shown. As described above, bracket 27 is pivotally mounted to chassis 15 along axis 28. Attached to one end of the top of bracket member 27 is protruding pin 49. Pin 49 is located directly above guide 23 and is used to focus the force applied to tape guide 23 onto the extended end of beam 50. In the preferred embodiment, pin 49 comprises an ordinary metal rod inserted into the end of bracket 27. Also included on the outward protruding arm of beam 50 is wheel 52 mounted along axis 53.

As upward force is applied to bracket 27 by the tension in tape 16, pin 49 forcibly presses against wheel 52. This, in turn, creates a strain or deflection in beam 50. This strain is detected by strain gauge 80 mounted along the interior sides of cavity 51. Strain gauge 80 is coupled to an amplifier which converts the strain into an analog voltage. This analog voltage may then be coupled to the system's control circuitry. In the case of a computer controller, this analog voltage is first converted to a digital signal using an ordinary analog-to-digital (A-to-D) converter. Upper tension beam 65 operates in a similar manner to lower tension beam 50. That is, bracket 14 includes a pin 49 which presses against a wheel 52 attached to one end of beam 65 causing a strain therein. The strain is detected by a strain gauge mounted along the interior of a cavity located within beam 65.

Tape speed and tape tension are controlled by servo mechanisms that are interfaced to a microprocessor-based computer which executes the user's process program. The servo mechanisms comprise ordinary closed-loop control systems which are well known to practitioners in the art. By way of example, power is first delivered to motor 37 and also to brake 36 in order to establish an initial tape speed and tension. The servo mechanisms then alter the delivered power until the actual tape speed and tension matched their programmed values.

FIG. 13 is a block diagram of the overall control system of the preferred embodiment of the present invention. The control system comprises a computer 60 which executes a program to control the general polishing process. Before the start of a process cycle, all of the important processing parameters are first input to computer 60 through keyboard interface 61. Normally, this includes tape speed and tension, however, other parameters such as load roller force, substrate rotational velocity, etc., may also be optionally input depending on the particular configuration of the finishing system. The inclusion of these other processing parameters as inputs to the process program depends on whether each is controllable by some sort of closed-loop servo mechanism.

In FIG. 13, break tension and motor speed are regulated by computer 60 through servo mechanisms 40 and 41, respectively. As shown, computer 60 supplies a programmed value of tape speed to servo 41 along line 55. Servo 41 then responds by delivering either current or voltage along line 56 to motor 37 to establish an initial speed. At the same time, servo 41 monitors the shaft speed of motor 37 along line 58, which is output from transducer 38. Recall that transducer 38 is coupled directly to the shaft of motor 37. This coupling is shown in FIG. 13 by dash line 69. Motor shaft speed is also provided to computer 60 along line 58. If, for example, servo 41 detects a shaft speed which is higher than its programmed value, it decreases the current or voltage supplied to motor 37 along line 56 until the shaft speed drops to its correct value. Thus, servo mechanism 41 is entirely closed-loop in nature. Once the programmed value of shaft speed is achieved during calibration, it remains at that value throughout the processing cycle.

Servo 40 controls the tape tension generated by brake 36 along line 62. The programmed value of tape tension is received by servo 40 from computer 60 on line 44. Servo 40 also receives a quantitative measure of tape tension from strain gauge instrumentation unit 47 across line 43. Strain gauge instrumentation unit 47 is used to sense the force $F_1$ developed on tape guide 13 and includes a strain gauge 80 along with the required instrumentation for sensing strain and converting it to a suitable signal. The relationship between the action of brake 36 and the tension measured by unit 47 is shown in FIG. 13 by dashed line 63. Tape tension $F_1$ is also coupled on line 43 to computer 60 for calibration purposes and for calculation of the work-performed factor $F_3$.

During calibration, servo 40 controls the current supplied to brake 36 across line 62. It establishes its programmed value of tape tension by comparing the measured value of tension on line 43 to its programmed value received from the computer 60 across line 44. Any deviation between the measured and programmed value causes servo 40 to change the amount of current or voltage being supplied to brake 36. Once the programmed value of tension is achieved, the power being supplied to brake 36 remains constant during the processing cycle in order to maintain a constant tension in the portion of tape 16 located between reel 11 and load roller 20.

Also shown in FIG. 13 are transducer 35 and strain gauge instrumentation unit 48. Transducer 35 provides a measure of the actual speed of tape 16 along line 42 to computer 60. This measurement is used to calibrate actual tape speed with motor shaft speed during successive processing cycles. Strain gauge instrument-ation unit 48 comprises lower tension beam 50 and provides a measure of the tension force $F_2$ to computer 60 along line 57. As previously mentioned, computer 60 utilizes forces $F_1$ and $F_2$ during calibration and also to calculate the work-performed factor $F_3$.

Computer 60 also receives an input from the ellipsometer 101 or other real-time measurement device which reports the measured thickness of the wafer film 30*a* during the polishing process. The computer 60 accepts the input from the ellipsometer 101 as the preferred process control measurement device. In the absence of an input from the ellipsometer 101, the computer 60 calculates and utilizes the work-performed factor to determine when to terminate the process.

Figure 14:
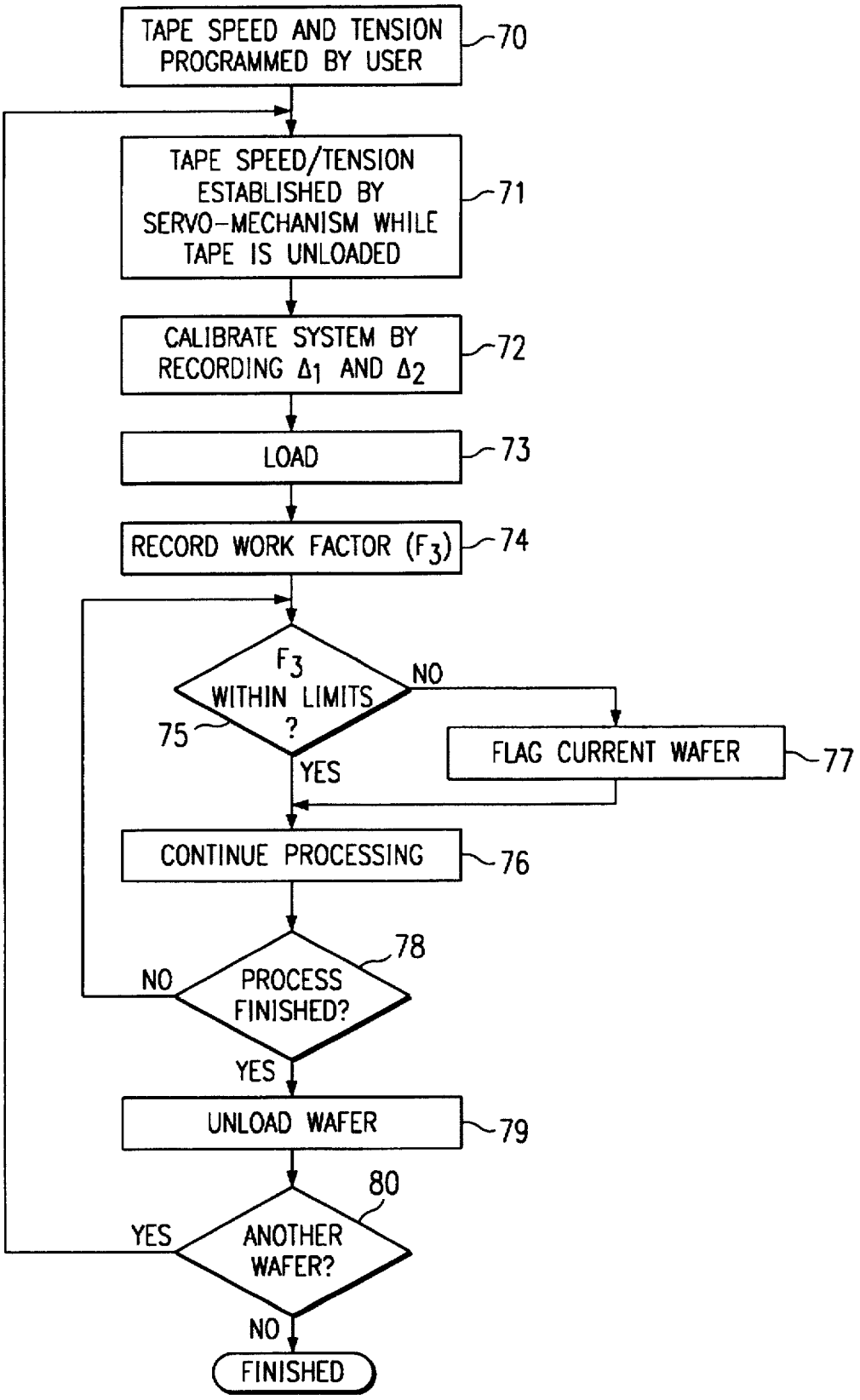
FIG. 14 is a flowchart which illustrates a typical processing cycle when the work-performed factor is utilized to determine when to terminate the polishing process.

With reference now to FIG. 14, a program flow chart for the back-up process utilizing the work-performed factor is shown. The first step in the processing cycle is the input of the tape speed and tape tension parameters by the user at step 70. Other relevant process parameters may also be input to the program as previously discussed. These optional parameters include load roller force, type of polishing tape, load roller oscillation rate, etc. In other words, the processing program may be written in such a way as to allow control over any of the process parameters which affect the work being performed at the nip.

Once tape speed and tension have been input by the user, the program begins execution. Tape speed and tape tension are initially established at step 71 by servo mechanisms 41 and 40, respectively, while the tape is in its unloaded position. After motor 27 is turning at its programmed speed and brake 36 is generating the proper tape tension, the system is calibrated at step 72 by recording values of $\Delta_1$ and $\Delta_2$.

The correction factor $\Delta_1$ is calculated by taking the difference between the tension measurement recorded by upper tension beam 65 against the measurement recorded by lower tension beam 50. This correction factor is included in the equation for determining the work-performed factor $F_3$. The difference $\Delta_2$ is calculated by taking the difference between actual tape velocity measured by transducer 38 as compared to the shaft speed of motor 37 as measured by transducer 39. This establishes the proper motor shaft speed for a given programmed tape velocity during a single processing cycle.

Once the system has been fully calibrated, the load roller is loaded against the wafer substrate surface at step 73. After the load roller has been loaded against the wafer surface, the processing program begins monitoring the work being performed on the substrate. To do this, the controller repeatedly calculates the difference between the tension force $F_1$ and $F_2$ as sensed by tension sensing beams 65 and 50, respectively. At step 74, the work-performed factor is stored for future reference in the computer's database.

Blocks 75 through 78 show how in-line, real-time process control monitoring is implemented. Once work on the substrate has commenced, the work-performed factor $F_3$ is monitored continuously to determine whether it falls within acceptable quality control limits. As long as the work-performed factor remains within an acceptable range of values at step 75, the program moves to step 76 and continues processing on that particular wafer until completion. However, if at any time $F_3$ exceeds either the upper or lower quality control limit (as may happen for instance where the particle size or mineral density changes drastically on abrasive tape 16), then the program moves to step 77 and issues a flag to record this condition. For an in-line system, an entry is made in the database indicating that the present wafer exceeds acceptable quality control standards. Alternatively, processing may be stopped whenever this limit is exceeded. At step 78, it is determined whether or not the process is finished. If not, the program returns to step 75 and determines whether or not the work-performed factor is still within limits. If so, processing continues until it is determined at step 78 that the process is finished. After the process cycle for a single wafer is completed, the load roller is unloaded from the wafer at step 79.

At step 80, the system determines whether or not another wafer needs to be processed. If so, the system returns to step 71 to establish tape speed and tape tension while the roller is in its unloaded state. The system is then recalibrated, the next wafer is loaded, the load roller is applied to the surface, and processing of the next wafer begins.

The system goes through a calibration sequence for each processing cycle because the radius of the tape changes from cycle to cycle as tape is unwound off of supply reel 11 and is collected on take-up reel 17. Other processing variables or instrumentation errors could also be introduced just prior to the beginning of a cycle. Thus, recalibration insures accurate and precise measurements in subsequent processing cycles without adding significantly to the total time of a processing session.

Figure 15:
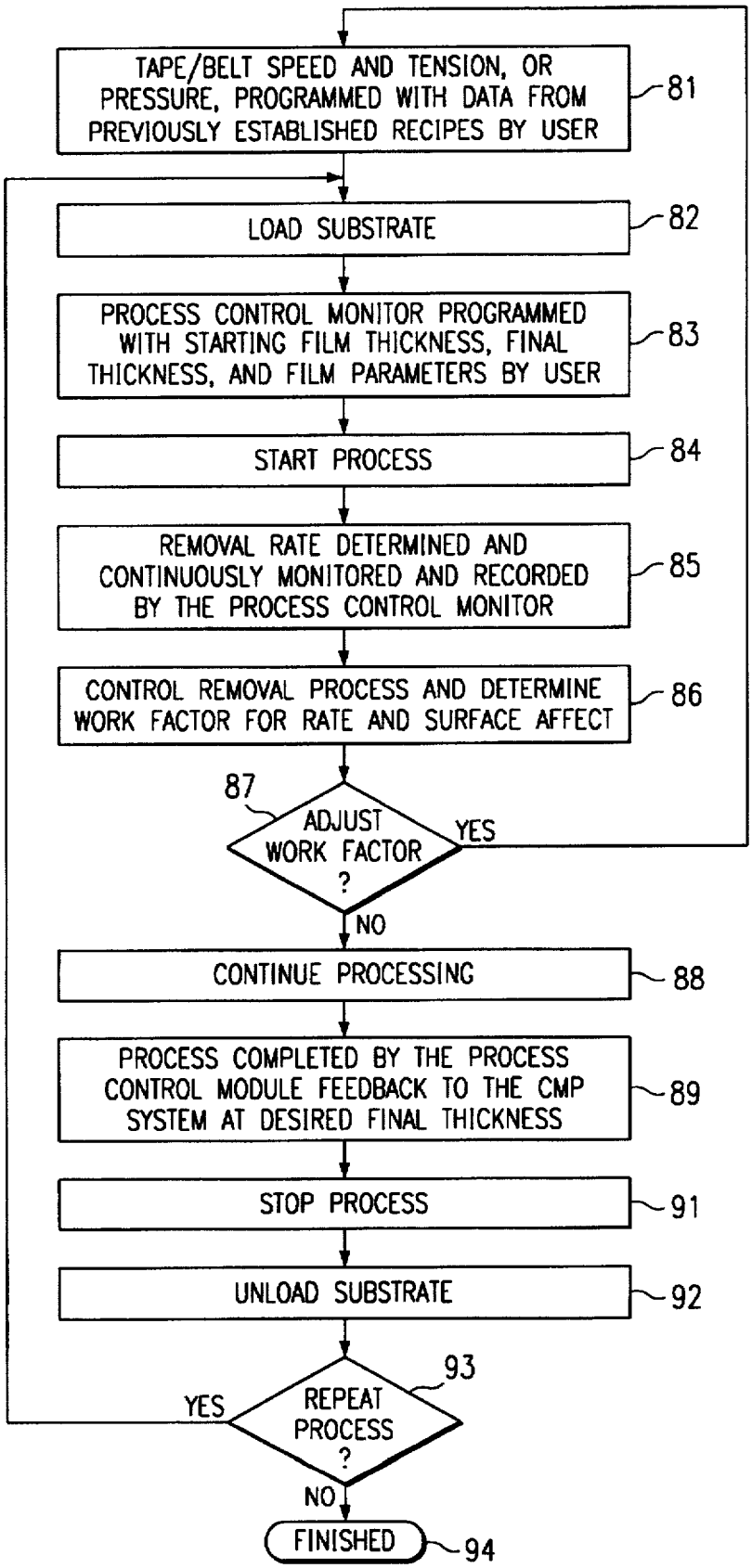
FIG. 15 is a flowchart which illustrates a typical processing cycle when a real-time measurement device is utilized to measure wafer film thickness and determine when to terminate the polishing process according to the teachings of the present invention.

FIG. 15 is a flowchart which illustrates a typical processing cycle when a real-time measurement device is utilized to measure wafer film thickness and determine when to terminate the polishing process according to the teachings of the present invention. At step 81, the tape/belt speed and tension, or pressure, are programmed with data from previously established recipes by the user. At step 82, the substrate (wafer) is loaded. At 83, the user programs the process control monitoring computer 60 with the starting film thickness, final desired thickness, and film parameters. The process starts at step 84, and at step 85, the process control monitoring computer 60 determines the removal rate and continuously monitors and records the rate. At step 86, the computer controls the removal rate and determines the work-performed factor. At step 87, the computer 60 determines whether or not the work-performed factor needs to be adjusted. If it is determined that the factor must be adjusted, the program returns to step 81 and re-programs the tape/belt speed and tension, or pressure of the roller on the wafer. If it is determined at step 87 that the work-performed factor does not need to be adjusted, then the program moves to step 88 where processing continues.

At step 89, the monitoring computer 60 receives an input that the process is completed when the wafer film reaches a desired predefined thickness. This input may be from a real-time measurement device such as the ellipsometer 101, or may be a computed input calculated from the work-performed factor and a timer report of the period of time that the work-performed factor has been utilized to polish the wafer. The desired predefined thickness of the surface film may be less than 100 angstroms for processed semiconductor wafers. Such thicknesses are repetitively achievable by the present invention regardless of the surface film's hardness, density, or index of refraction. The process is stopped at step 91, and the substrate is unloaded at 92. At 93, it is determined whether or not the process is to be repeated with another wafer. If yes, then the program returns to step 82 where another wafer substrate is loaded. If the process is not to be repeated, the program ends at step 94.

It is thus believed that the operation and construction of the present invention will be apparent from the foregoing description. While the method, apparatus and system shown and described has been characterized as being preferred, it will be readily apparent that various changes and modifications could be made therein without departing from the spirit and scope of the invention as defined in the following claims.

What is claimed is:

1. A method of automatically polishing a semiconductor wafer having a substrate and a surface film, said method comprising the steps of:

holding said semiconductor wafer without requiring that said wafer have a central aperture;

polishing one surface of said wafer to a microscopically smooth surface by applying a polishing tape to the surface film of the wafer with a tape transport mechanism, said tape contacting said surface film in a line;

determining the thickness of said surface film in real time while polishing said wafer; and automatically controlling said polishing step with a control computer, said automatic controlling step including the steps of:

providing measurements of said surface film thickness to said control computer in real time; and stopping said polishing step when the thickness of said surface film, averaged over the entire surface of said wafer, achieves a predefined value.

2. The method of automatically polishing a semiconductor wafer of claim 1 wherein said step of holding said semiconductor wafer without requiring that said wafer have a central aperture includes holding said wafer with a vacuum chuck.

3. The method of automatically polishing a semiconductor wafer of claim 2 wherein said step of polishing one surface of said wafer to a microscopically smooth surface includes:

mounting said wafer on a mounting mechanism; and moving said mounting mechanism in an orbit-within-an-orbit motion.

4. The method of automatically polishing a semiconductor wafer of claim 3 wherein said step of mounting said wafer on a mounting mechanism includes supplying a negative pressure of approximately 10 Torr to said vacuum chuck with a rotary vacuum mechanism.

5. The method of automatically polishing a semiconductor wafer of claim 4 wherein said step of determining the thickness of said surface film in real time includes measuring the thickness of said surface film with an ellipsometer.

6. The method of automatically polishing a semiconductor wafer of claim 1 wherein said step of polishing one surface of said wafer to a microscopically smooth surface includes:

mounting said wafer on a mounting mechanism;

moving said mounting mechanism in an orbit-within-an-orbit motion; and applying an abrasive polishing tape to the surface film of the moving wafer with a tape transport mechanism.

7. The method of automatically polishing a semiconductor wafer of claim 1 wherein said step of mounting said wafer on a mounting mechanism includes supplying a negative pressure of approximately 10 Torr to said vacuum chuck with a rotary vacuum mechanism.

8. The method of automatically polishing a semiconductor wafer of claim 1 wherein said step of determining the thickness of said surface film, in real time, includes measuring the thickness of said surface film with an ellipsometer.

9. The method of automatically polishing a semiconductor wafer of claim 1 wherein said step of polishing one surface of said wafer to a microscopically smooth surface by applying a polishing tape to the surface film of the wafer includes applying a polishing tape from the group consisting of:

dry impregnated abrasive tape;

wet impregnated abrasive tape;

dry impregnated chemical tape;

wet impregnated chemical tape;

dry fabric web tape; and wet fabric web tape.

10. The method of automatically polishing a semiconductor wafer of claim 9 wherein said step of applying a dry impregnated abrasive tape includes applying a polishing tape having an abrasive embedded in a binder system which is coated onto a flexible backing.

11. The method of automatically polishing a semiconductor wafer of claim 9 wherein said step of applying a wet impregnated abrasive tape includes applying a polishing tape having an abrasive embedded in a binder system which is coated onto a flexible backing.

12. The method of automatically polishing a semiconductor wafer of claim 9 wherein said step of applying a wet impregnated abrasive tape includes applying a polishing tape that utilizes liquid slurry as a wetting agent.

13. The method of automatically polishing a semiconductor wafer of claim 9 wherein said step of applying a wet fabric web tape includes applying a polishing tape that utilizes liquid slurry as a wetting agent.

14. The method of automatically polishing a semiconductor wafer of claim 9 wherein said step of applying a wet impregnated abrasive tape includes applying a polishing tape that utilizes liquid chemicals as a wetting agent.

15. The method of automatically polishing a semiconductor wafer of claim 9 wherein said step of applying a wet impregnated chemical tape includes applying a polishing tape that utilizes liquid chemicals as a wetting agent.

16. The method of automatically polishing a semiconductor wafer of claim 9 wherein said step of applying a wet fabric web tape includes applying a polishing tape that utilizes liquid chemicals as a wetting agent.

17. A method of automatically polishing a semiconductor wafer having a substrate and a surface film, said method comprising the steps of:

holding said semiconductor wafer with a mounting mechanism without requiring that said wafer have a central aperture;

polishing one surface of said wafer to a microscopically smooth surface, said polishing step comprising:

moving said mounting mechanism in an orbit-within-an-orbit motion; and applying a polishing tape to the surface film of the wafer with a tape transport mechanism, said tape transport mechanism including a roller around which said polishing tape arcuately passes, said tape passing between said roller and said surface film and contacting said surface film in a line running across the width of the tape;

measuring the thickness of said surface film with an ellipsometer in real time while polishing said wafer; and automatically controlling said polishing step with a control computer, said automatic controlling step including the steps of:

providing measurements of said surface film thickness to said control computer in real time; and stopping said polishing step when the thickness of said surface film, averaged over the entire surface of said wafer, achieves a predefined value.

18. The method of automatically polishing a semiconductor wafer of claim 17 wherein said step of applying a polishing tape to the surface film of the wafer includes applying a polishing tape from the group consisting of:

dry impregnated abrasive tape;

wet impregnated abrasive tape;

dry impregnated chemical tape;

wet impregnated chemical tape;

dry fabric web tape; and wet fabric web tape.

19. The method of automatically polishing a semiconductor wafer of claim 18 wherein said step of applying a wet impregnated abrasive tape to the surface film of the wafer includes applying a polishing tape that utilizes liquid slurry as a wetting agent.

20. The method of automatically polishing a semiconductor wafer of claim 18 wherein said step of applying a wet impregnated chemical tape to the surface film of the wafer includes applying a polishing tape that utilizes liquid chemicals as a wetting agent.

* * * * *